US006199728B1

(12) United States Patent
Cohen

(10) Patent No.: US 6,199,728 B1
(45) Date of Patent: Mar. 13, 2001

(54) GARMENT HANGER WITH INTEGRAL CREASE-FREE CLAMPS

(75) Inventor: Bernard J. Cohen, Spring Valley, NY (US)

(73) Assignee: The Accessory Corporation, New York, NY (US)

( * ) Notice: Subject to any disclaimer, the term of this patent is extended or adjusted under 35 U.S.C. 154(b) by 0 days.

(21) Appl. No.: 09/175,292

(22) Filed: Oct. 20, 1998

Related U.S. Application Data

(63) Continuation-in-part of application No. 08/882,048, filed on Jun. 25, 1997, now abandoned, which is a continuation-in-part of application No. 08/798,584, filed on Feb. 10, 1997, now abandoned.

(51) Int. Cl.[7] ..... A47G 25/48
(52) U.S. Cl. ..... 223/96; 223/93; 223/91
(58) Field of Search ..... 223/95, 96, 93, 223/91, 85; 24/561, 562, 556, 564, 521, 571, 507

(56) References Cited

U.S. PATENT DOCUMENTS

| | | | | |
|---|---|---|---|---|
| D. 142,813 | * | 11/1945 | Andrews | D17/6 |
| 2,920,801 | | 1/1960 | Batts | 223/96 |
| 2,950,939 | * | 8/1960 | Van Volkenburgh | 24/556 |
| 3,767,092 | | 10/1973 | Garrison et al. | 223/96 |
| 4,194,274 | | 3/1980 | Garrison | 24/248 |
| 5,020,705 | | 6/1991 | Garrison | 223/96 |
| 5,170,916 | | 12/1992 | Kolton et al. | 223/92 |
| 5,183,190 | | 2/1993 | Zuckerman | 223/96 |
| 5,183,191 | | 2/1993 | Garrison et al. | 223/96 |
| 5,297,706 | | 3/1994 | Blitz | 223/96 |
| 5,361,948 | | 11/1994 | Batts | 223/96 |
| 5,398,854 | | 3/1995 | Blanchard | 223/96 |
| 5,692,806 | * | 12/1997 | Jones | 297/483 |
| 5,890,634 | * | 4/1999 | Zuckerman et al. | 223/96 |

* cited by examiner

*Primary Examiner*—Bibhu Mohanty
(74) *Attorney, Agent, or Firm*—David P. Gordon; David S. Jacobson; Thomas A. Gallagher

(57) ABSTRACT

A clamp-type garment hanger defined by a pair of opposed jaw members between which a garment is hung. The opposed jaw members have gripping members and opposed non-ribbed gripping surfaces having an enhanced coefficient of friction. The gripping members, opposed gripping surfaces with enhanced coefficient of friction and jaw members are all formed by injection molding in one piece from the same material, which may include either polystyrene, polypropylene, polyethylene, styrene-butadiene copolymers and blends, or polycarbonates. The coefficient of friction is provided to the gripping surface by forming a texture or pattern on the surface with relief structure which does not exceed a maximum elevation, or maximum depth, from the surface. The texture or pattern may be provided by molding, engraving, acid etching, electrical discharge machining, vapor honing, or sandblasting.

19 Claims, 5 Drawing Sheets

GARMENT HANGER WITH INTEGRAL CREASE-FREE CLAMPS

This application is a continuation-in-part application of application Ser. No. 08/882,048 filed Jun. 25, 1997 now abandoned entitled "Garment Hanger With Integral Crease-Free Clips," which is a continuation-in-part of application Ser. No. 08/798,584 filed Feb. 10, 1997 now abandoned entitled "Garment Hanger With Integral Crease-Free Clips," all of which are hereby incorporated by reference.

BACKGROUND OF THE INVENTION

1. Field of the Invention

The present invention relates to hangers. More specifically, the present invention relates to a clamping-type garment hanger which prevents unwanted creases or imprints, and which is more economical to manufacture than clamping-type garment hangers heretofore in use.

2. Discussion of the Related Art

Clamping-type garment hangers have heretofore been provided for the suspension or hanging of articles such as pants, skirts, etc. Such hangers include at least one clamp typically defined by a pair of opposed clamp or jaw members between which the article is placed. Provision is made for biasing the members together to create the clamping force necessary to retain the article between the inner surfaces of the jaw members. To further retain the article between the inner surfaces of the members, the clamp or jaw members also have heretofore included on its inner surfaces either or both of teeth elements and a friction surface separately attached to the inner surfaces of the clamp or jaw members.

For example, U.S. Pat. No. 4,194,274 to Garrison entitled "Garment Grip Construction for Hangers" discloses a clamping-type garment hanging device on which teeth 70 and 88 are placed to grip and secure the garment to the hanger. Also, U.S. Pat. No. 3,767,092 to Garrison et al. entitled "Garment Clamping Hanger with Slidable Locking Clip" discloses a clamping-type garment hanging device on which teeth generally indicated as 42 are placed to secure the garment to the hanger. These clamp-type garment hangers which utilize teeth, often sharp or otherwise pointed, suffer from the drawback of introducing unwanted creases, marks, holes, projections or disfigurations to the garment. Where the garment is especially delicate, these hangers heretofore in use can be particularly harmful to the garment.

U.S. Pat. No. 5,183,191 to Garrisonetal entitled "Hangers with Long Lasting Non-Slip Surfaces" discloses a clamp-type garment hanging device on which resilient pad 23 is molded. Pad 23 is adhered to or molded to the hanger by an expensive and complicated process whereby resilient friction material, when in a molten state, is applied to the inner surfaces of the jaw. Similarly, U.S. Pat. No. 5,020,705 to Garrison entitled "Article Gripping Means and Method of Making Same" discloses a clamp-type garment hanging device on which gripping pad 20 is separately attached to hanger 11. This attaching process is also expensive and introduces undesirable complexities into the manufacturing process. Moreover, the material from which these gripping pads have been made have an unwanted tendency to become sticky when subject to increased temperatures. This can become particularly harmful to garments when hangers of this sort are used to transport garments over long distances, often in very hot conditions. Thus, garments may be damaged or otherwise harmed by use of such hangers heretofore in use.

SUMMARY OF THE INVENTION

Accordingly, it is an object of the present invention to provide a clamp-type garment hanging device which does not leave an unwanted crease or imprint on the garment. It is a further object of the present invention to provide a clamp-type garment hanging device which is less expensive and faster and easier to manufacture than clamp-type garment hangers heretofore in use. It is a further object of the present invention to provide a clamp-type garment hanger which provides an equal or greater grip area, yet which does not stick to garments, or its opposing grip area, in higher temperatures.

In accordance with the preferred embodiment, a clamp-type garment hanger is disclosed which comprises at least one clamp attached to a body, the clamp having a hinge, the clamp further having at least two jaw members, wherein one jaw member is pivotable about the hinge, and where the other jaw member is not pivotable about the hinge, the jaw members being capable of a first open position where the one jaw member is pivoted away from the other jaw member, and a second closed position where the one jaw member is urged towards the other jaw member, the jaw members having opposed gripping surfaces for gripping in the second closed position, wherein the opposed gripping surfaces are integrally formed with the jaw members by injection molding in one piece. The opposed gripping surfaces have non-ribbed friction enhancing surfaces, preferably molded thereon, with minimal projection. Furthermore, the substantially smooth opposed gripping surfaces and said jaw member are formed from substantially identical materials selected from the group consisting of polystyrene, polypropylene, polyethylene, styrenebutadiene copolymers and blends, or polycarbonates.

BRIEF DESCRIPTION OF THE DRAWINGS

The above and still further objects, features and advantages of the present invention will become apparent upon consideration of the following detailed description of a specific embodiment thereof, especially when taken in conjunction with the accompanying drawings, wherein.

DETAILED DESCRIPTION OF THE PRESENTLY PREFERRED EXEMPLARY EMBODIMENT

Figure 1:
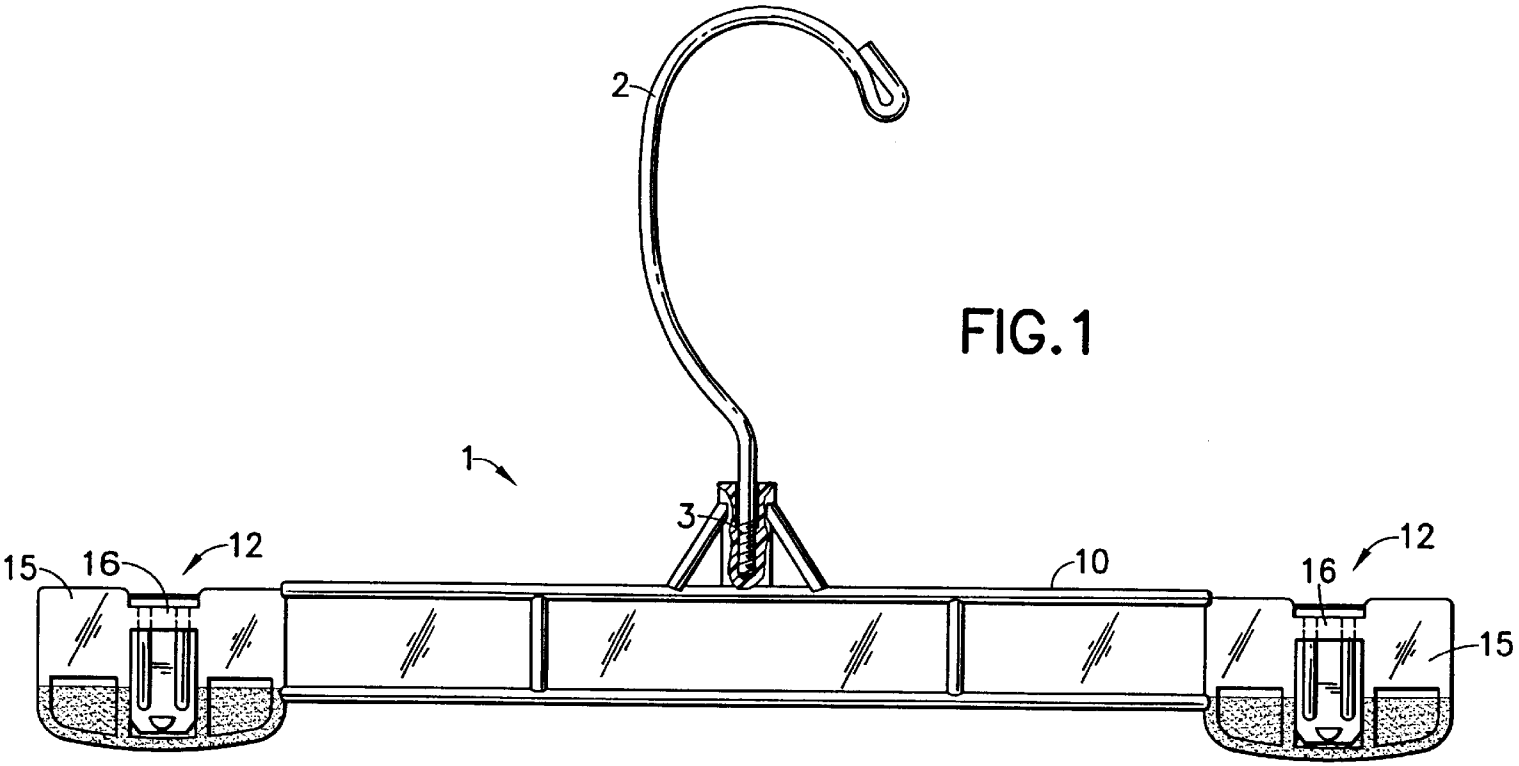
FIG. 1 is a rear view of the garment hanging device according to the present invention.

Referring now to FIG. 1, a clamp-type garment hanger 1 in accordance with the present invention is shown. Clamp-type garment hanger 1 includes a partial loop or hook member 2, which may be formed from plastic or aluminum or any other appropriate material. The partial loop or hook member 2 may be secured via threads 3 to body 10, as shown, or may be integrally formed from the same material as body 10.

Clamp-type garment hanger has body 10, and has at its ends clamps generally indicated as 12. Clamps 12 may be formed from the same material as body 10, and may also be molded or otherwise formed integrally with body 10. It is noted that, although shown with clamp 12 at each of its ends, the present invention recognizes that only one clamp 12 may be used.

Figure 3:
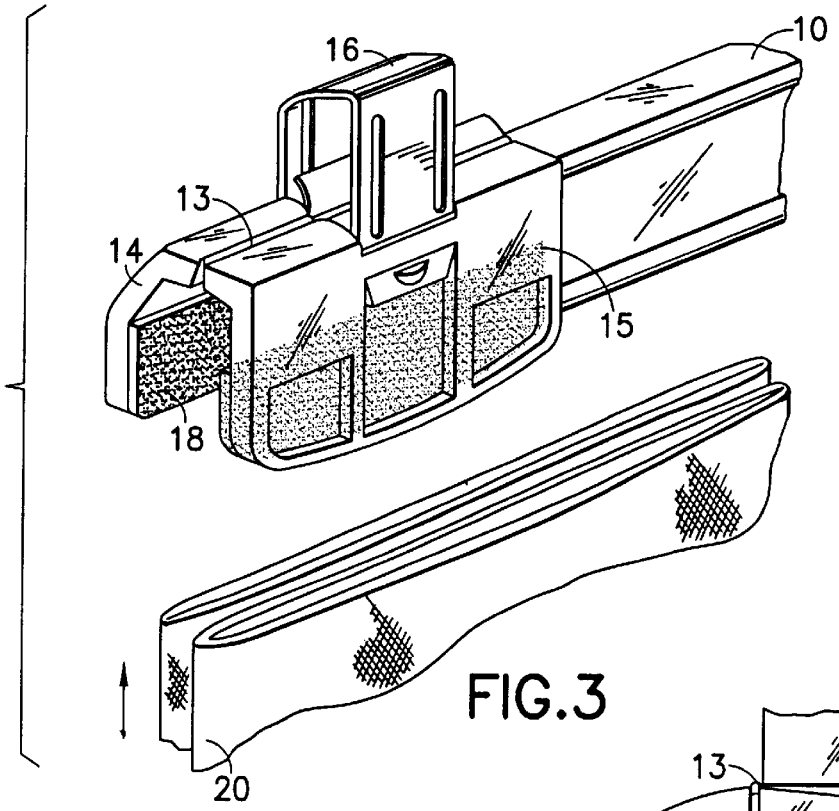
FIG. 3 is a perspective view of the garment hanging device according to the present invention.
Figure 4:
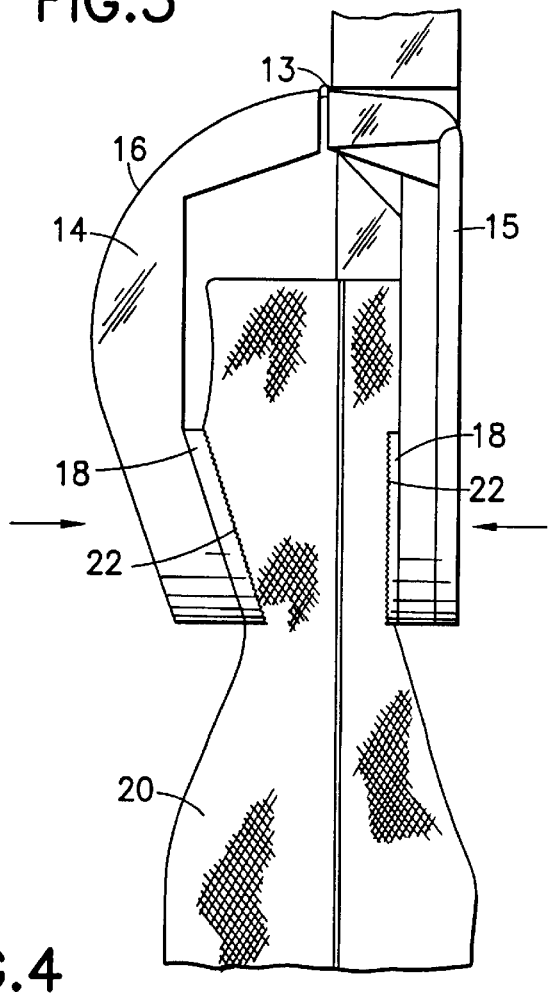
FIG. 4 is a side view of an alternative embodiment of the garment hanging device according to the present invention.
Figure 5:
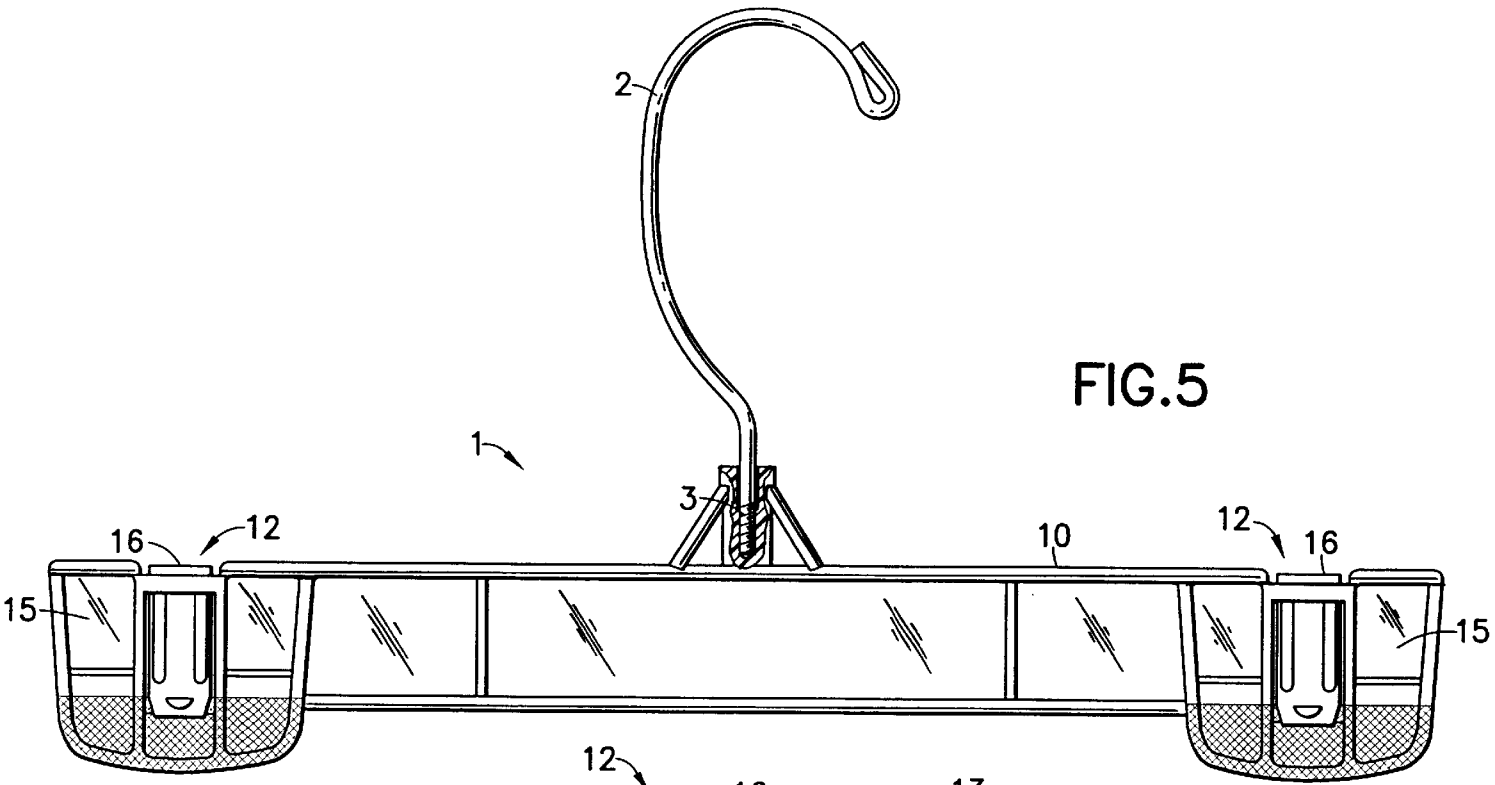
FIG. 5 is a rear view of an alternative embodiment of the garment hanging device according to the present invention.
Figure 6:
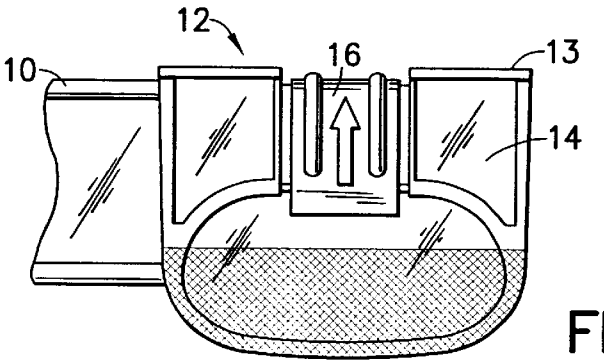
FIG. 6 is a close-up front view of the alternative embodiment of the garment hanging device according to the present invention shown in FIG. 5.
Figure 7:
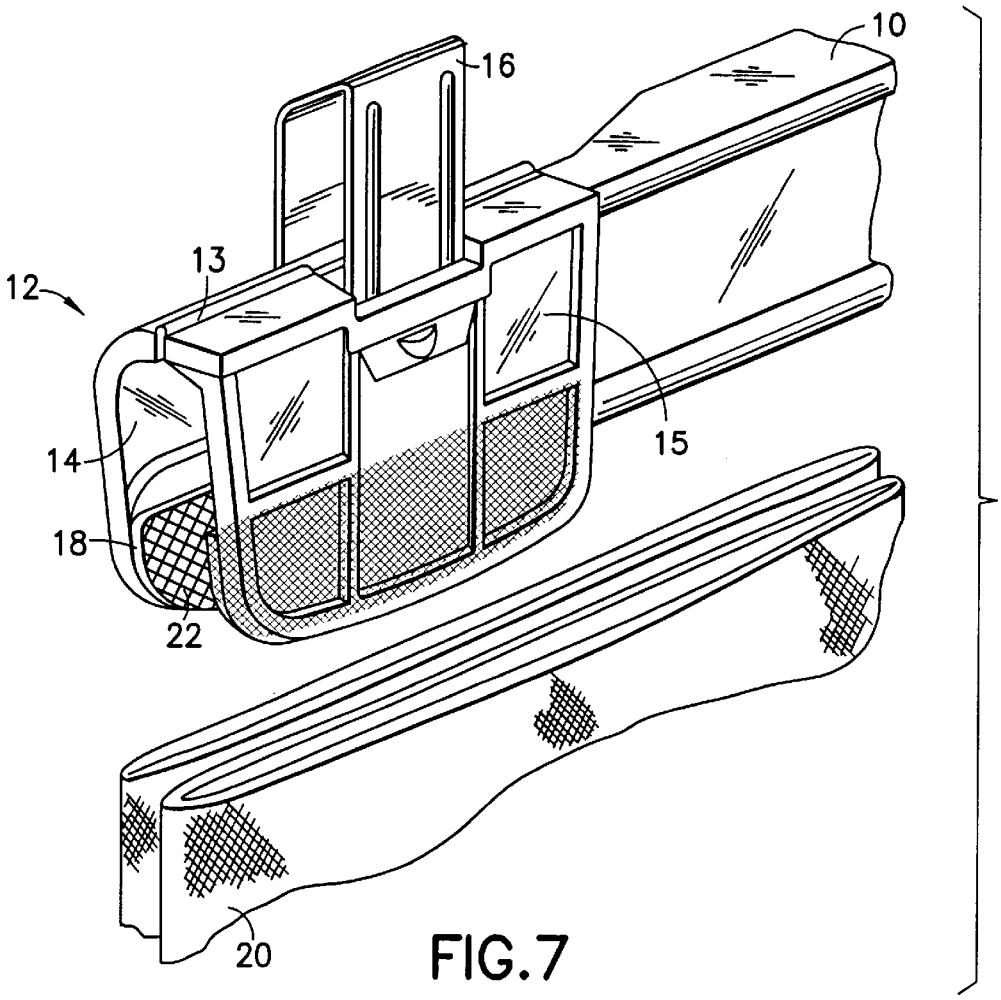
FIG. 7 is a perspective view of the alternative embodiment of the garment hanging device according to the present invention shown in FIG. 5.

As best shown in FIGS. 3 and 4, clamp 12 has along its upper edge a hinge 13. Clamp 12 includes a front jaw member 14 and a rear jaw member 15. Each jaw member 14 and 15 has gripping members 18. Gripping members 18, in turn, include opposed non-ribbed gripping surfaces 22. Each gripping surface 22 is provided with an increased coefficient of friction by treating or forming the gripping surface 22 such that a non-ribbed pattern or texture having a minimal relief is provided to each gripping surface 22. The minimal relief of the pattern or texture of each gripping surface 22 minimizes or eliminates unwanted effects on the fabrics of delicate garments.

The elements of clamp 12, namely, hinge 13, jaw members 14 and 15, gripping members 18 and gripping surfaces 22 are integrally formed. That is, these elements of clamp 12 are all formed preferably, for example, by injection molding in one piece from a substantially identical material or materials. The presently preferred embodiment contemplates that these materials may include polystyrene, polypropylene, polyethylene, styrene-butadiene copolymers and blends, or polycarbonates.

Figure 2:
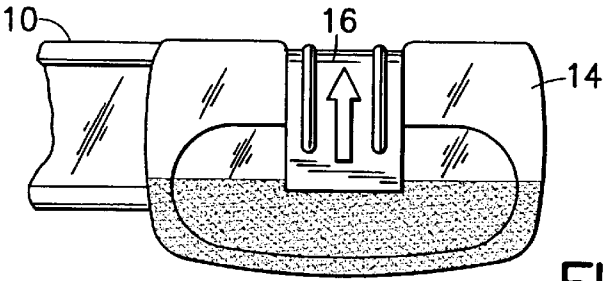
FIG. 2 is a close-up front view of the garment hanging device according to the present invention.

Front jaw member 14 is capable of pivoting about hinge 13, while rear jaw member 15 is stationary with respect to hinge 13. Clamp 12 also includes a biasing clip 16 which may be formed from a metal or any other appropriate material. Biasing clip 16, although part of clamp 12, is not integrally formed with clamp 12. As best shown in FIGS. 2 and 3, biasing clip 16 is positioned above hinge 13, and has two legs which respectively abut the front and rear jaw members 14 and 15, respectively.

Clamp 12 may occupy a closed position when biasing clip 16 is in its vertically lowered position, as shown in FIGS. 2 and 4. In this position, the legs of biasing clip 16, and more particularly the leg which abuts front jaw member 14, is lowered such that front jaw member 14 may not pivot about hinge 13. In this closed position, gripping members 18 via opposed gripping surfaces 22 serve to secure and support garment 20.

To release garment 20, the jaw members are moved to an open position. Specifically, to achieve this open position, biasing clip 16 is moved to its raised position, as shown in FIG. 3, such that front jaw member 14 may pivot about axis 13 away from rear jaw member 15.

The present invention has the advantages of providing a clamping surface which does not harm the fabric of the garment. Also, because the jaw members, the gripping members and the non-ribbed gripping surfaces having an increased coefficient of friction are all formed from the same material by, for example, injection molding in one piece, manufacturing costs may be greatly reduced compared to prior hangers. In addition, to increase the coefficient of friction of the opposed gripping surfaces, the non-ribbed pattern or texture may be molded into each gripping surface 22, or each gripping surface 22 may be treated by engraving, acid etching, electrical discharge machining, vapor honing, or sandblasting to provide a pattern or texture to enhance the coefficient of friction. The molded pattern or texture may take on a random form or may be uniform in nature. In either case, the pattern or texture should have structure that projects minimally from each gripping surface, or conversely, that has voids projecting minimally into each gripping surface, so that damage or undesired effects to the fabric of garments clamped in the hanger, particularly delicate fabrics, is minimized or eliminated.

Figure 8:
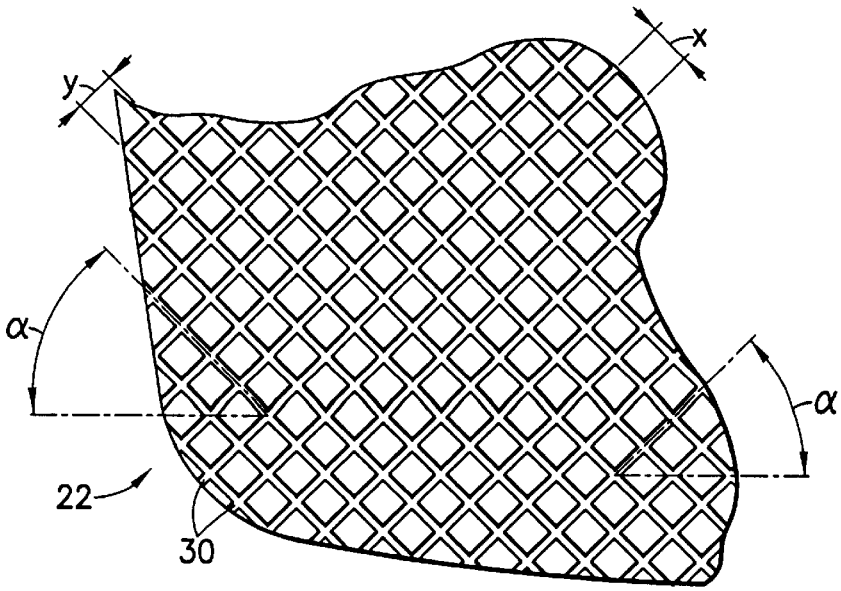
FIG. 8 is partial view of the gripping surface of the alternative embodiment of the garment hanging device according to the present invention shown in FIG. 5.
Figure 9:
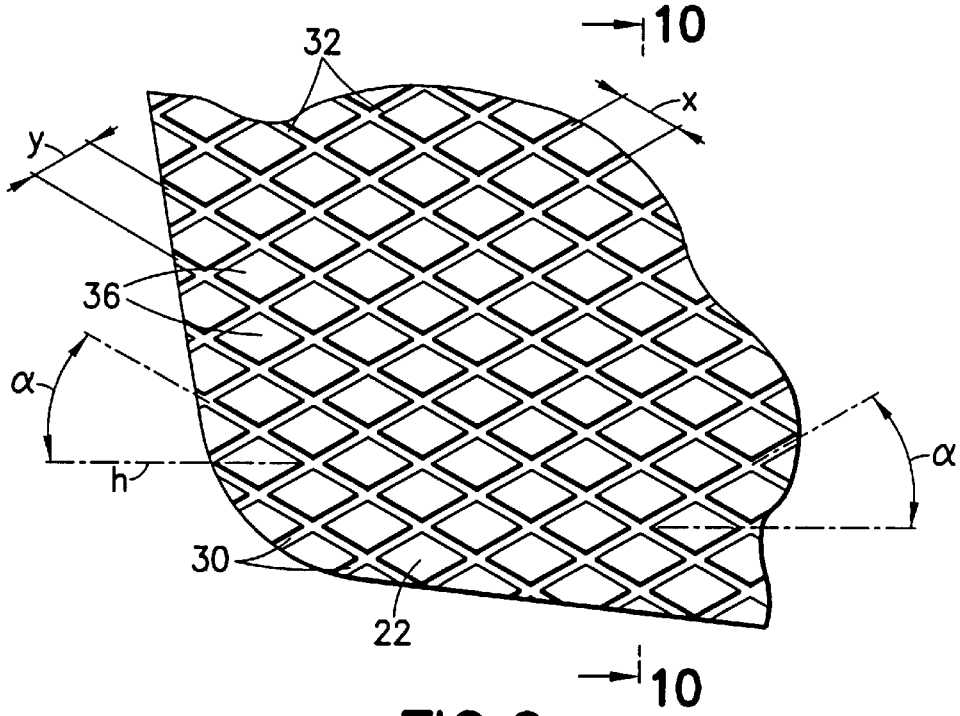
FIG. 9 is a partial view of an alternative embodiment of the gripping surface of the garment hanging device according to the present invention.

Preferably, the pattern provided to each gripping surface 22 is a "cross-hatch" or "diamond" pattern as depicted in FIGS. 5–10. Referring to FIGS. 8 and 9, the preferred pattern has a first set of parallel grooves 30 in each gripping surface 22 with an interval x between the grooves 22. A second set of parallel grooves 32 in each gripping surface 22, with an interval y between the grooves, are provided transverse to the grooves 30 to form diamond-shaped projections 36. The preferred interval for each of x and y is equal, and falls within a range of 0.1 to 1.0 mm, with each interval preferably having a measurement of approximately 0.5 mm. As shown in FIGS. 8 and 9, the diamond shape of the projections 36 may be altered by varying an angle $\alpha$ of the grooves 30, 32 relative to a horizontal axis h drawn through horizontally opposite corners of the diamond shape of projections 36. The preferred angle $\alpha$ is approximately 30°.

Figure 10:
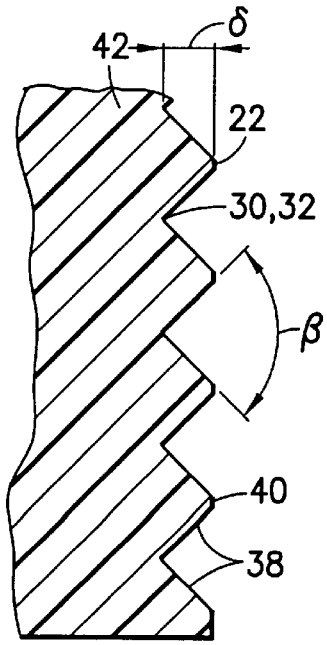
FIG. 10 is a cross sectional view taken along sectional line 10—10 in FIGS. 8 and 9 showing the depth of the frictional structure of the gripping surface of the garment hanging device according to the present invention.

Although the diamond shape of the projections can be varied to accommodate different fabrics, and to vary the coefficient of friction provided by the gripping surface pattern, it has been found that the critical dimension for the purpose of minimizing or eliminating damage or unwanted effects to delicate fabrics while maximizing the coefficient of friction provided by the pattern or texture is the depth $\delta$ (FIG. 10) of the pattern or texture relative to the gripping surface 22. It will be understood that the depth $\delta$ of the texture or pattern is established by creating voids in the gripping surface, as, for example by way of molding, etching, engraving or sandblasting techniques, or conversely, the depth $\delta$ of the texture or pattern is established by creating structure projecting from the gripping surface, as for example, by molding the pattern onto the gripping surface. In either case, the depth $\delta$ of the structure of the texture or pattern relative to the gripping surface is selected to minimize or eliminate damage or undesirable effects to delicate fabrics while maximizing the coefficient of friction. In the preferred embodiment, the depth $\delta$, measured from the gripping surface 22 to the bottom of each of the grooves 30, 32 is in a range of 0.01 to 0.50 mm, and preferably for delicate fabrics is no greater than 0.25 mm. The opposite walls 38 of the grooves 30, 32 are provided at an angle $\beta$ relative to each other. The preferred angle for $\beta$ is approximately 90°. The peak 40 of the projection 42 may be pointed, or as shown in FIG. 10, may be truncated such that a planar portion of gripping surface 22 is provided for contacting the fabric 20.

Having described the presently preferred exemplary embodiment of a new and improved garment hanging device in accordance with the present invention, it is believed that other modifications, variations and changes will be suggested to those of skill in the art in view of the teachings set forth herein. It is, therefore, to be understood that all such modifications, variations and changes are believed to fall within the scope of the present invention as defined by the claims appended hereto.

What is claimed is:

1. A clamp-type garment hanger for holding an article, comprising:

a) a body having at least one clamp attached to said body, said clamp having a hinge and at least two jaw members having opposed non-ribbed gripping surfaces, wherein at least one jaw member is pivotable about said hinge relative to said other jaw member, said jaw members being capable of a first open position where said one jaw member is pivoted away from said other jaw member, and a second closed position where said one jaw member is urged towards said other jaw member such that the article may be gripped between said gripping surfaces, said opposed gripping surfaces being integrally formed with said jaw members by injection molding in one piece with substantially identical materials, and wherein at least one of said opposed gripping surfaces has relatively blunt relief structure which provides an increased coefficient of friction to said at least one of said opposed gripping surface, said blunt relief structure defining a plurality of voids having a death of not more than approximately 0.5 mm; and b) a hook member coupled to said body.

2. A clamp-type garment hanger according to claim 1, wherein said material may be selected from the group consisting of polystyrene, polypropylene, polyethylene, styrenebutadiene copolymers and blends, or polycarbonates.

3. A clamp-type hanger according to claim 1, wherein said at least one of said opposed gripping surfaces is engraved to increase the coefficient of friction.

4. A clamp-type hanger according to claim 1, wherein said at least one of said opposed gripping surfaces is acid etched to increase the coefficient of friction.

5. A clamp-type hanger according to claim 1, wherein said at least one of said opposed gripping surfaces is treated by electrical discharge machining to increase the coefficient of friction.

6. A clamp-type hanger according to claim 1, wherein said at least one of said opposed gripping surfaces are treated by vapor honing to increase its coefficient of friction.

7. A clamp-type hanger according to claim 1, wherein said at least one of said opposed gripping surfaces is treated by sandblasting to increase the coefficient of friction.

8. A clamp-type garment hanger according to claim 1 wherein said plurality of voids in said relief structure have a depth of less than or equal to 0.25 mm.

9. A clamp-type garment hanger according to claim 1 wherein said plurality of voids define a first plurality of parallel grooves in the gripping surface and a second plurality of parallel grooves in the gripping surface, the first plurality of parallel grooves transversely oriented to the second plurality of parallel grooves.

10. A clamp-type hanger according to claim 1, wherein: said relief structure is non-projecting.

11. A clamp-type hanger according to claim 1, wherein: said relief structure of said at least one of said opposed gripping surfaces is defined by grooves.

12. A clamp-type hanger according to claim 11, wherein: said grooves are provided in a cross-hatch pattern.

13. A clamp-type hanger according to claim 11, wherein: said grooves have a depth substantially between 0.01 mm –0.5 mm.

14. A clamp-type garment hanger for holding an article, comprising:

a) a body having at least one clamp attached to said body, said clamp having a hinge and at least two jaw members having opposed non-ribbed gripping surfaces, wherein at least one jaw member is pivotable about said hinge relative to said other jaw member, said jaw members being capable of a first open position where said one jaw member is pivoted away from said other jaw member, and a second closed position where said one jaw member is urged towards said other jaw member such that the article may be gripped between said gripping surfaces, said opposed gripping surfaces being integrally formed with said jaw members by injection molding in one piece with substantially identical materials, and wherein at least one of said opposed gripping surfaces is provided with grooves which define a blunt relief structure which provides an increased coefficient of friction to said at least one of said opposed gripping surface, said grooves having a depth of not more than approximately 0.5 mm; and b) a hook member coupled to said body.

15. A clamp-type hanger according to claim 14, wherein: said grooves are provided in a cross-hatch pattern.

16. A clamp-type hanger according to claim 14, wherein: said grooves are comprised of a first set of substantially parallel grooves and a second set of substantially parallel grooves transverse to said first set of substantially parallel grooves.

17. A clamp-type hanger according to claim 16, wherein: when said hanger is hanging by said hook, both said first set of substantially parallel grooves and said second set of substantially parallel grooves are angled relative to a horizontal line.

18. A clamp-type hanger according to claim 14, wherein: said grooves of said first set of substantially parallel grooves are spaced at 0.1 mm to 1.0 mm intervals along said at least one of said clamping surfaces.

19. A clamp-type hanger according to claim 18, wherein: said grooves of said second set of substantially parallel grooves are spaced at substantially the same interval as said first set of substantially parallel grooves.

* * * * *

UNITED STATES PATENT AND TRADEMARK OFFICE

CERTIFICATE OF CORRECTION

PATENT NO. : 6,199,728 B1
DATED : March 13, 2001
INVENTOR(S) : Bernard J. Cohen

It is certified that error appears in the above-identified patent and that said Letters Patent is hereby corrected as shown below:

Column 5,
Line 24, replace “death” with -- depth --.

Signed and Sealed this

Twenty-second Day of July, 2003

JAMES E. ROGAN
*Director of the United States Patent and Trademark Office*